US005673630A

United States Patent [19]

Schutz

[11] Patent Number: 5,673,630

[45] Date of Patent: Oct. 7, 1997

[54] PALLET WITH SUPPORTING CENTER FEET

[75] Inventor: Udo Schutz, Selters, Germany

[73] Assignee: Schutz-Werke GmbH & Co. KG, Selters, Germany

[21] Appl. No.: 407,662

[22] Filed: Mar. 21, 1995

[30] Foreign Application Priority Data

Mar. 21, 1994 [DE] Germany ..... 9404764 U

[51] Int. Cl.[6] ..... B65D 19/44

[52] U.S. Cl. ..... 108/55.1; 108/51.1

[58] Field of Search ..... 108/51.1, 55.1, 108/55.3, 55.5, 901

[56] References Cited

U.S. PATENT DOCUMENTS

| | | | |
|---|---|---|---|
| 4,848,711 | 7/1989 | Mandel | 108/55.3 X |
| 4,930,632 | 6/1990 | Eckert et al. | 108/55.1 X |
| 5,020,667 | 6/1991 | Bush | 108/5.1 X |
| 5,133,460 | 7/1992 | Shuert | 108/55.1 X |
| 5,249,699 | 10/1993 | Williams | 108/55.1 X |
| 5,253,777 | 10/1993 | Schutz . | |
| 5,359,955 | 11/1994 | Grebenyuk | 108/51.1 |
| 5,429,236 | 7/1995 | Evans | 108/55.1 X |

*Primary Examiner*—José V. Chen
*Attorney, Agent, or Firm*—Young & Thompson

[57] ABSTRACT

A pallet (1) is made of steel or plastic, with a sublime (2), corner feet (7) and center feet (15, 16), a base pan (8) made of sheet metal, resting on feet (7, 15, 16), with a drainage bottom (9), which has a drainage channel (10). Base pan (8) holds, with positive fit, an internal container (11) made of plastic with an outer jacket (12) made of sheet metal or lattice work and a drainage bottom (13), or forms part of a sheet metal container. A stiffening sheet (14), made like a girder, is fastened under the base pan (8), crosswise to its drainage channel (10). Further to provide greater transport security and simplification of construction, two center feet (15, 16) are integrally molded on both ends (14a, 14b) of the stiffening sheet (14) that is made like a bridge.

2 Claims, 4 Drawing Sheets

PALLET WITH SUPPORTING CENTER FEET

FIELD OF THE INVENTION

The invention relates to a pallet of steel or plastic with a subframe, corner and middle feet, a base pan of sheet metal resting on the feet and with a drainage bottom that has a drainage channel, and the base pan holds, with positive fit, an inside container made of plastic with an outer jacket of sheet metal or lattice work and a drainage bottom, or forms part of a sheet metal container, as well as with a stiffening sheet, made like a girder, fastened under the base pan, crosswise to its drainage channel.

In a of this type known from DE 42 06 945 C1, the stiffening sheet fastened centrally between both cross frames of the frame for the feet is welded or screwed to two center feet, which in turn are welded to both lengthwise frames of the pallet.

Besides the relatively expensive manufacturing caused by its structure, this pallet has the further drawback that, because of bending stress loads caused by wave oscillations being emanated during the transport of liquids in the container and by motion oscillations transmitted to the pallet by the transport vehicle, the base pan, in the area of the connection points between both center feet and the stiffening sheet, because of a relatively quick fatigue of the sheet metal material, gets tears, so that the transport safety of the pallet is no longer guaranteed.

SUMMARY OF THE INVENTION

The object of the invention is to further develop the generic pallet with respect to greater transport safety and a provides a simplified construction, with the goal of economical manufacturing.

The one-piece, bridge-like design of the stiffening sheet for the base pan of the pallet, together with two center feet, makes it possible to have a favorable introduction of the occurring bending forces from the base of the base pan, through the bridge-like stiffening sheet, into the center feet, so that the formation of tears in the base pan is avoided, and thus the transport safety of the pallet is guaranteed. By producing the stiffening sheet together with both center feet as a press-drawn part, the strength of this part is again increased because of the cold forming, and the manufacturing of the pallet becomes simpler and thus less expensive.

BRIEF DESCRIPTION OF THE DRAWINGS

The invention is described in more detail below based on an embodiment represented in the drawing. There are shown in FIG. 1, a top view of a pallet without base pan, FIG. 2, a lengthwise section of the along line II—II and FIG. 3, a cross section of the pallet along line III—III of FIG. 1 with base pan in an enlarged representation and FIGS. 4 to 7, cross sections through the stiffening sheet and a center foot along line IV—IV, V—V, VI—VI, and VII—VII of FIG. 3 in an enlarged representation.

DETAILED DESCRIPTION OF THE DRAWING

Figure 1:
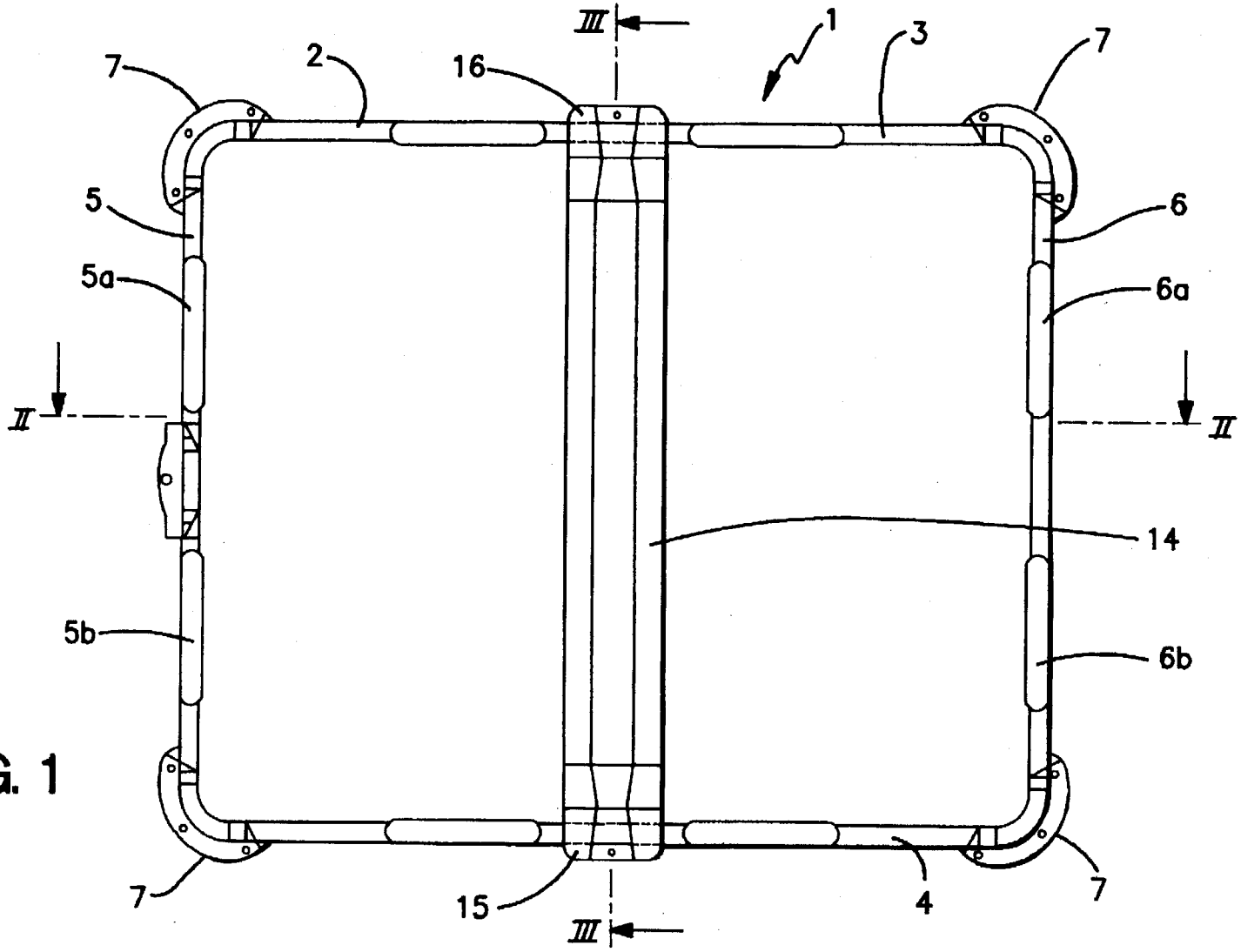
Figure 2:
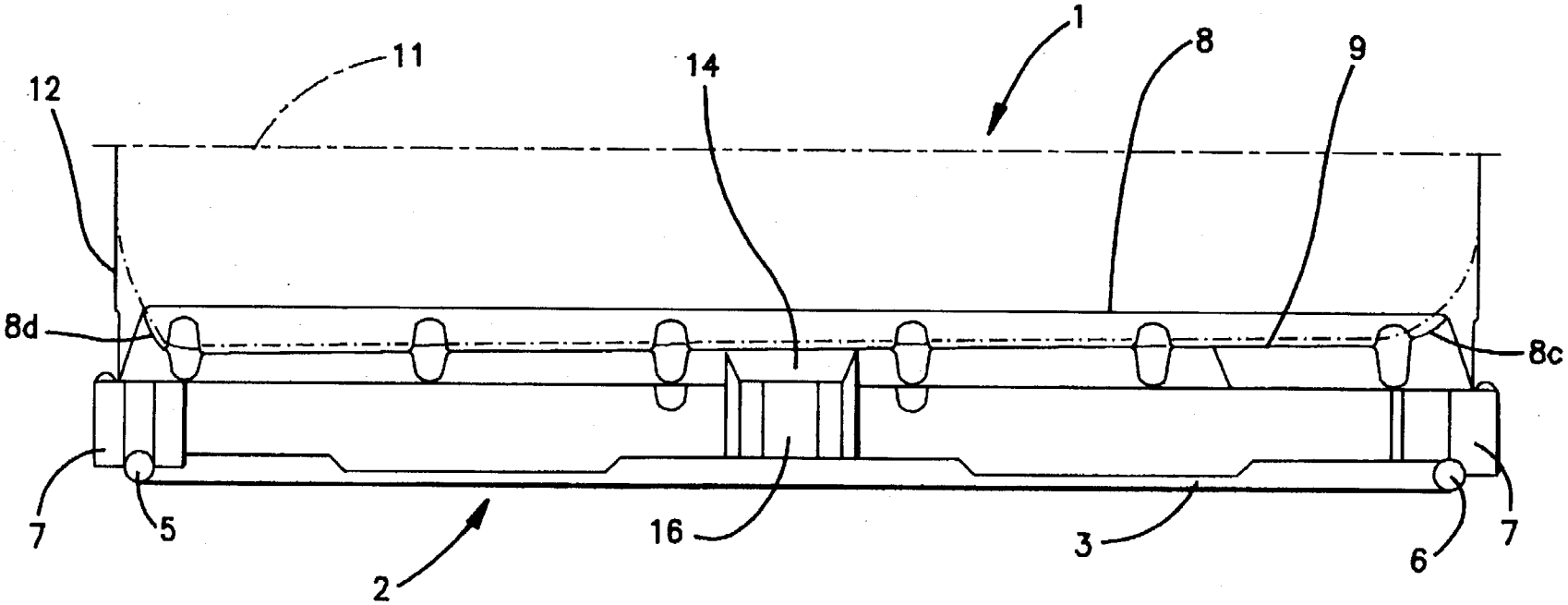
Figure 3:
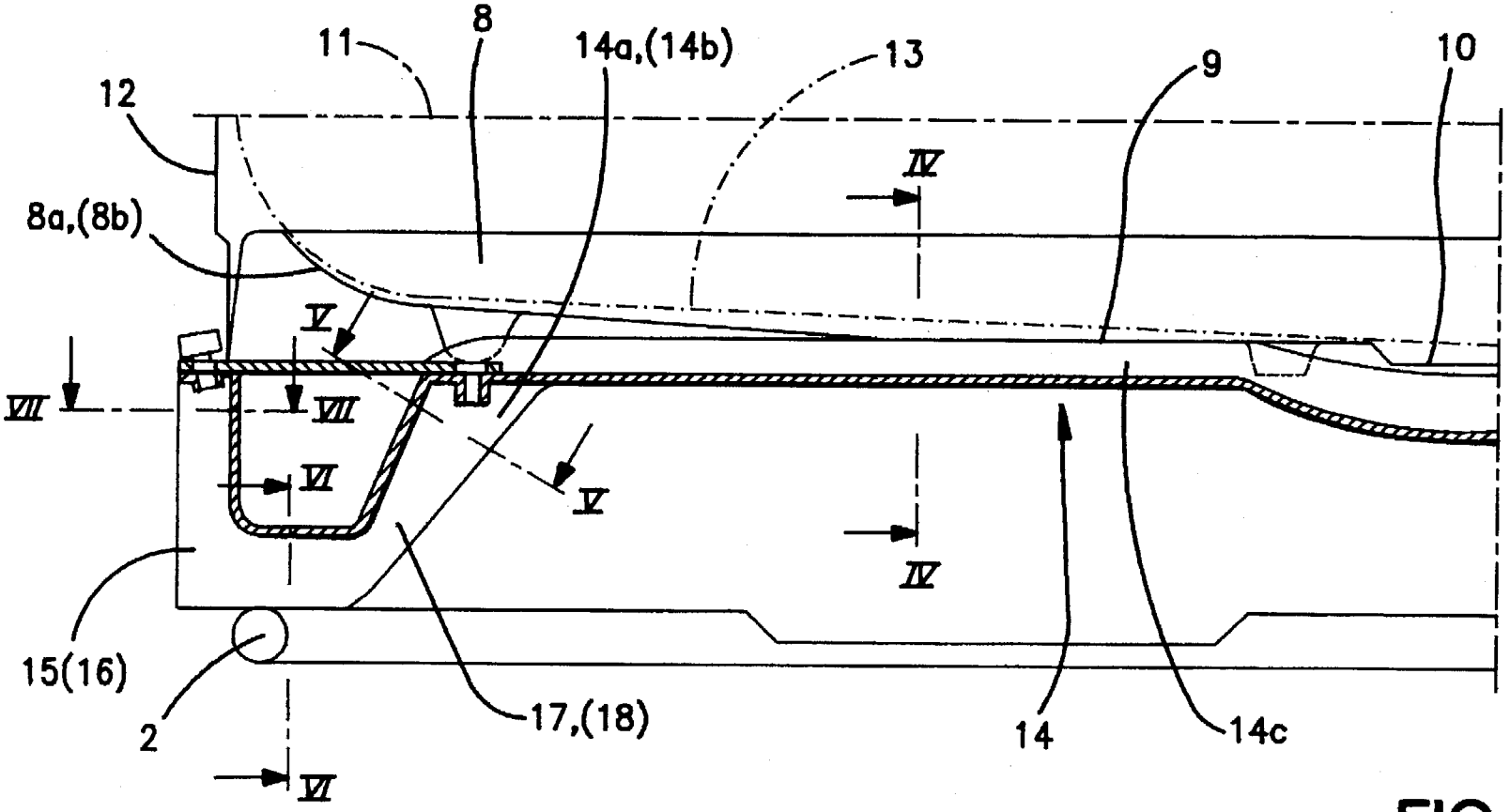
Figure 4:
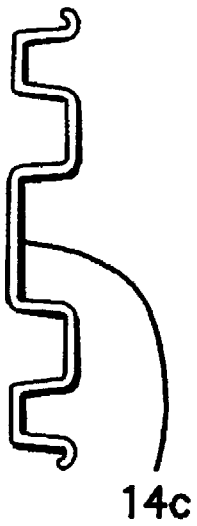
Figure 5:
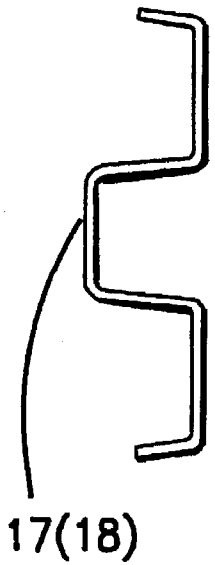
Figure 6:
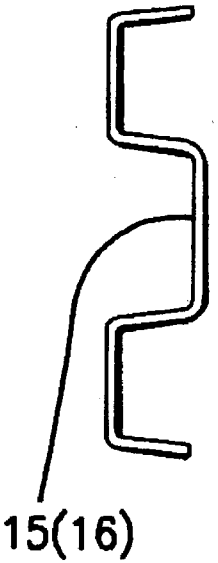
Figure 7:
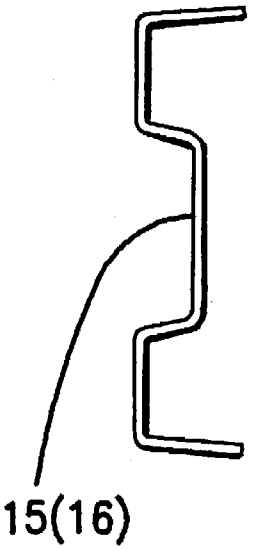

Pallet 1 has a rectangular subframe 2 made of steel tube with two lengthwise frames 3, 4 and two cross frames 5, 6. Four corner feet 7 are welded on subframe 2. Two support yokes 5*a*, 5*b* and 6*a*, 6*b* are extruded in each case on both cross frames 5, 6.

A base pan 8 made of sheet metal is tightly screwed onto four corner feet 7 and four support yokes 5*a*, 5*b* and 6*a*, 6*b* of cross frames 5, 6 of subframe 2.

Bottom 9 of base pan 8 descends slightly from both lateral pan edges 8*a*, 8*b* toward the center of the bottom and, further, it has a slight slope from rear pan edge 8*c* toward front pan edge 8*d*. In this way, bottom 9 of pan 8 forms a flat drainage channel 10 running with a slight slope from rear pan edge 8*c* toward front pan edge 8*d*.

Base pan 8 of pallet 1 holds, with positive fit, an internal container 11 made of plastic with an outer jacket 12 made of sheet metal and a drainage bottom 13.

A stiffening sheet 14, made like a girder, is tightly screwed in under bottom 9 of base pan 8, centrally between cross flames 5, 6 and running crosswise to drainage channel 10 of the pan, a stiffening sheet on both of whose ends 14*a*, 14*b* two center feet 15, 16 are integrally molded, which are welded with lengthwise flames 3, 4 of subframe 2.

Section 14*c* of stiffening sheet 14 fastened under base pan 8 merges, via legs 17, 18 that are oriented outward at an angle, with center feet 15, 16.

Stiffening sheet 14 with center feet 15, 16 is designed as a profile part and produced as a press-draw part.

I claim:

1. Pallet made of steel and having: a subframe, corner and side feet; a base pan made of sheet metal resting on the feet, said base pan having a sloped drainage bottom which forms a drainage channel, said base pan adapted to hold, with positive fit, an internal container having a drainage pan, said internal container being made of plastic with an outer jacket made of sheet metal lattice work; a reinforcing strip secured under the base pan and running crosswise to the drainage channel; a supporting foot integrally formed at each end of said reinforcing strip, wherein a section of said reinforcing strip merges via legs oriented outwardly at an angle, with said supporting feet, and wherein the reinforcing strip with supporting feet is manufactured as a press-drawn part.

2. Pallet according to claim 1, wherein said reinforcing strip and supporting feet are bent in a plurality of directions in cross-section.

* * * * *